US006352105B1

(12) United States Patent
Serratto

(10) Patent No.: US 6,352,105 B1
(45) Date of Patent: Mar. 5, 2002

(54) SERVOCONTROLLED VALVE FOR AIR-CONDITIONING SYSTEMS KNOWN AS FOUR PIPE SYSTEMS

(76) Inventor: Angelo Serratto, Via Chiossetto 11, Milano (IT)

( * ) Notice: Subject to any disclaimer, the term of this patent is extended or adjusted under 35 U.S.C. 154(b) by 0 days.

(21) Appl. No.: 09/494,017

(22) Filed: Jan. 28, 2000

(30) Foreign Application Priority Data

Jan. 29, 1999 (IT) ..... MI99A0173

(51) Int. Cl.[7] ..... F25B 29/00

(52) U.S. Cl. ..... 165/221; 137/597; 137/625.11; 137/627; 236/1 B; 236/1 C; 145/50; 145/299

(58) Field of Search ..... 165/221, 50, 299; 137/627, 625.11, 597; 236/1 B, 1 C

(56) References Cited

U.S. PATENT DOCUMENTS

| | | | | | |
|---|---|---|---|---|---|
| 1,856,226 | A | * | 5/1932 | Rustin et al. | 137/625.11 |
| 2,377,473 | A | * | 6/1945 | Wolcott | 137/625.11 |
| 2,384,318 | A | * | 9/1945 | Le Bleu | 137/625.11 |
| 3,170,508 | A | * | 2/1965 | Avery | 236/1 C |
| 3,181,604 | A | * | 5/1965 | Kritzer | 165/50 |
| 3,241,602 | A | * | 3/1966 | Andreassen | 165/221 |
| 3,406,744 | A | * | 10/1968 | Scheibler | 165/221 |
| 3,411,538 | A | * | 11/1968 | Gruner | 165/221 |
| 3,443,592 | A | * | 5/1969 | Felmlee | 137/625.11 |
| 3,889,878 | A | * | 6/1975 | Evans | 236/1 B |
| 4,501,297 | A | * | 2/1985 | Baker | 137/625.11 |
| 4,930,540 | A | * | 6/1990 | Oddenino | 237/12.3 B |
| 5,261,451 | A | * | 11/1993 | Spencer | 137/625.11 |
| 5,307,838 | A | * | 5/1994 | d'Agostino et al. | 137/627 |
| 5,623,965 | A | * | 4/1997 | Snider et al. | 137/627 |
| 6,012,487 | A | * | 1/2000 | Hauck | 137/625.11 |
| 6,012,488 | A | * | 1/2000 | Nichols | 137/625.11 |

FOREIGN PATENT DOCUMENTS

| | | | | |
|---|---|---|---|---|
| EP | 0434634 | * | 6/1991 | 237/12.3 B |
| FR | 2479397 | * | 10/1981 | 237/12.3 B |

* cited by examiner

*Primary Examiner*—John K. Ford
(74) *Attorney, Agent, or Firm*—Akin, Gump, Strauss, Hauer & Feld, L.L.P.

(57) ABSTRACT

Servocontrolled valve for regulating air-conditioning apparatuses with fan-convectors, inductors and the like, with water distribution by means of the so-called "four pipe system", comprising a stationary ceramic collector disk (1), a movable ceramic distributor disk (2) with rotational movement controlled by a control pin (5) and a metal case (8) wherein hydraulic connections are provided, with closing lid (9). On disk (1) three pairs of ports are provided (11, 12; 13, 15; 14, 16) one of which is connected with the single thermal exchange heat exchanger and the other two with the hot water and refrigerated water pipes, rigorously sequentially, one of the pairs being always shut off by movable disk (2). With such a six-way rotating valve also the proportionality between the flow rate of the cooling or heating fluid being fed to the heat exchanger and the angle of rotation of movable disk are ensured, as a function of the signal given to the servocontrol.

7 Claims, 4 Drawing Sheets

Figure 1:
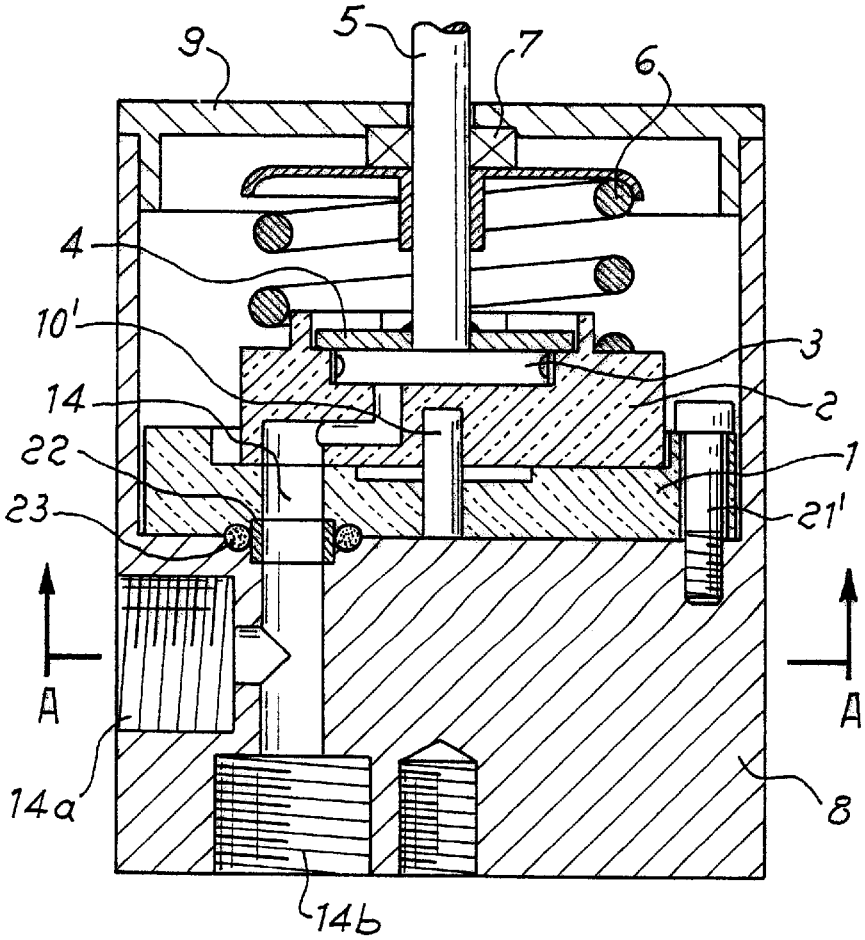

Fig. 3
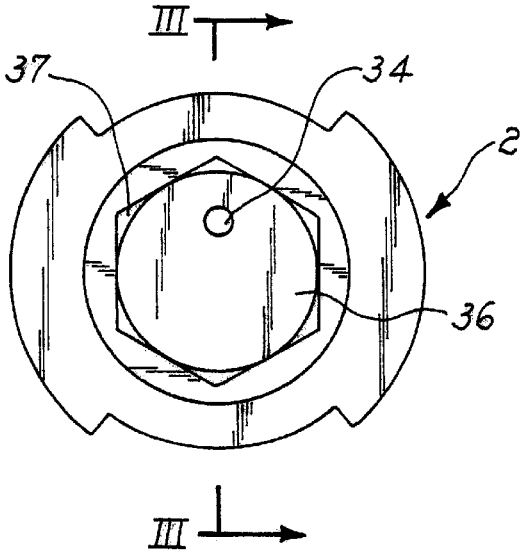
Fig. 4
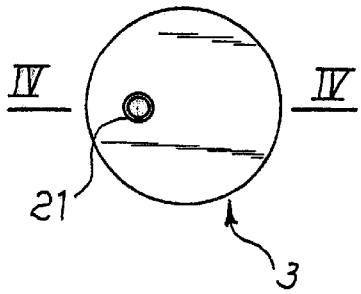
Fig. 3a
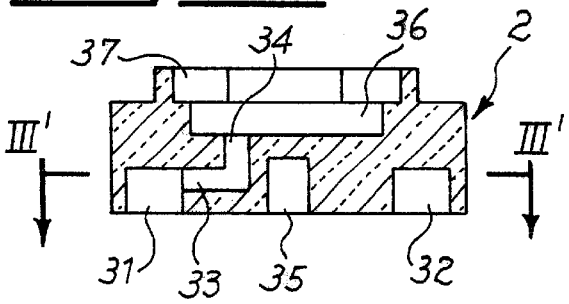
Fig. 4a
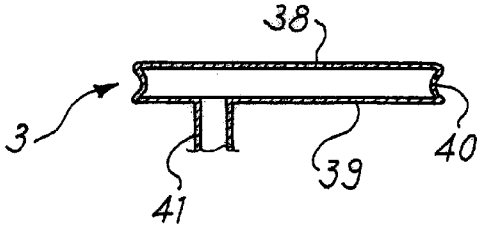
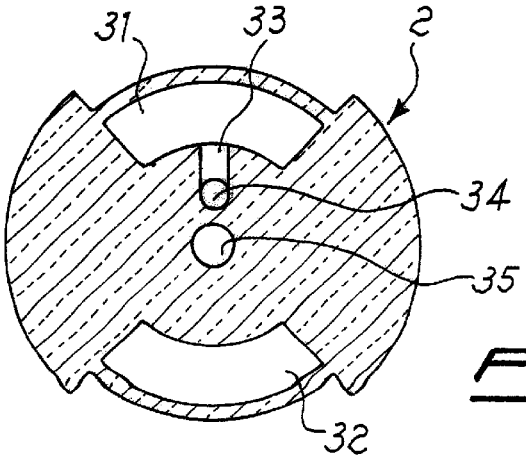
Fig. 3b

SERVOCONTROLLED VALVE FOR AIR-CONDITIONING SYSTEMS KNOWN AS FOUR PIPE SYSTEMS

DETAILED DESCRIPTION OF THE INVENTION

The present invention relates to a servovalve for air-conditioning systems with terminal apparatuses formed of fan-convectors, inductors or the like, with contemporaneous supply of hot and refrigerated water by means of four pipes, two for the delivery and two for the return, known as "four pipe systems".

It is known that, at present, each terminal apparatus of this kind of system associated to two heat exchangers, one of which is passed through by hot water and the other one by refrigerated water, both being provided with a servovalve in order to control the water flow from the relevant delivery pipe. A generally electronic thermostatic device senses the temperature of the environment wherein the apparatus or "local unit" is installed and controls the two valves sequentially, by means of a rectilinear movement of a control means, such as a shutter. If the sensed temperature tends to rise above the calibration value, the "cold" heat exchanger controlling valve opens; on the contrary, if the temperature tends to lower, the "hot" heat exchanger controlling valve opens. It is absolutely necessary that, when one of the valves is open, the other one be closed in order to avoid the contemporaneous operation of the two heat exchangers resulting in mixing of the two water flows and in a waste of energy. However, for various reasons, such a sequence may fail to occur, owing either to a thermostatic device defect or to a defect of the valve sealing.

It is also known that, due to overall size reasons, in the present local apparatuses the "hot" heat exchanger has a much smaller heat exchange surface than the "cold" one, thereby the hot water being fed must have a high temperature, which results in a considerable thermal dispersion from the pipes and does not allow the use of alternative energy sources such as heat pumps or solar collectors, by which particularly high temperatures cannot be obtained.

Therefore, the first object of the present invention is to eliminate one of the two valves and one of the two heat exchangers for each local apparatus of a "four pipe" conditioning system, thus reducing the equipment's cost and avoiding that contemporary liquid flows having different temperatures occur in the apparatus, with notable economic advantages due to both a certain reduction in the equipment's cost, and the resulting energy gain.

Another object of the present invention is obtaining a better proportionality between valve stroke and liquid flow, with respect to the one obtainable with the rectilinearly moving valves of the prior art, as well as the independence of the valve operation from the hydraulic pressure of the circuit, with a simplification of the automatic control, since controlling two valves in sequence is no longer necessary, in addition to a simplification of the hydraulic connections.

A further object of the present invention is allowing to change in a particularly simple way the control valve characteristic, which is generally indicated with $K_v$, corresponding to the water flow rate in $m^3/h$ for a 1 bar pressure drop. In fact, by the valve according to the present invention it is possible to obtain different $K_v$ values with the same valve, by adapting the characteristic thereof to that of the circuit that it has to control. Finally, it is possible to use alternative energy sources for heating the water that, with the valve according to the present invention, does not necessarily have to reach particularly high temperatures.

Said objets and advantages are obtained by means of a six-way rotating valve whose structural features are specified in claim 1.

Particularly preferred embodiments are obtainable through the features of the claims dependent from claim 1.

Figure 1A:
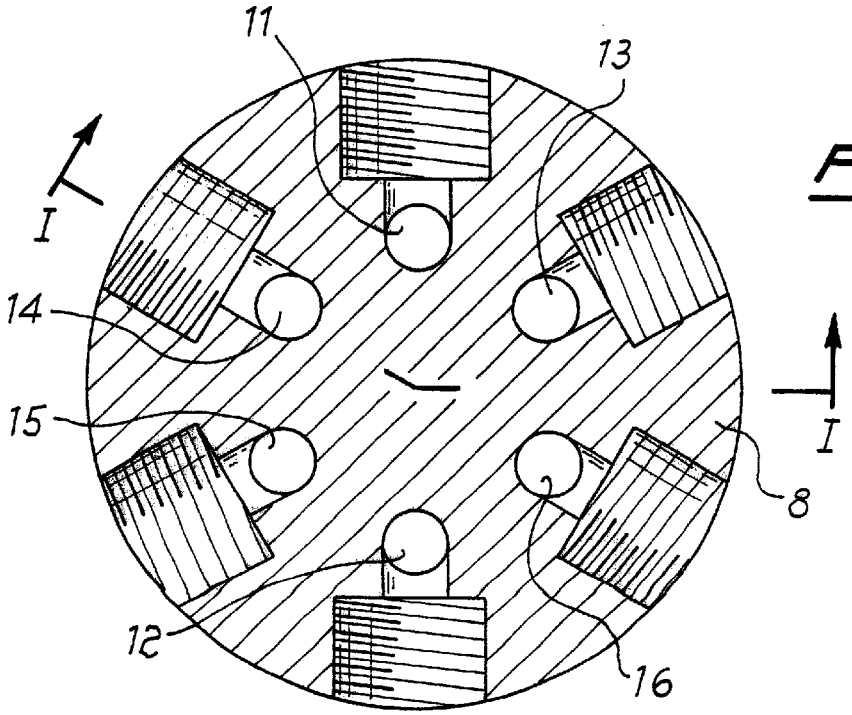
Figure 2:
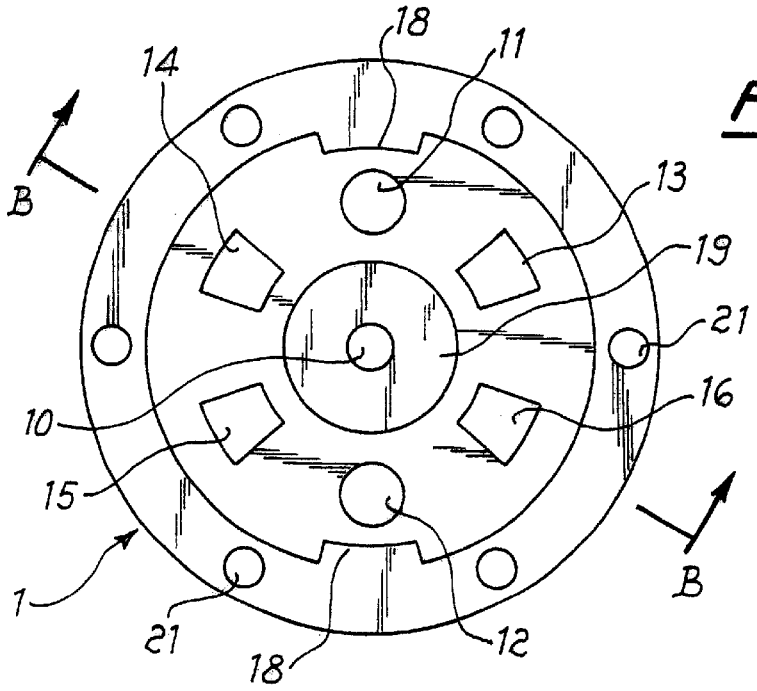
Figure 2A:
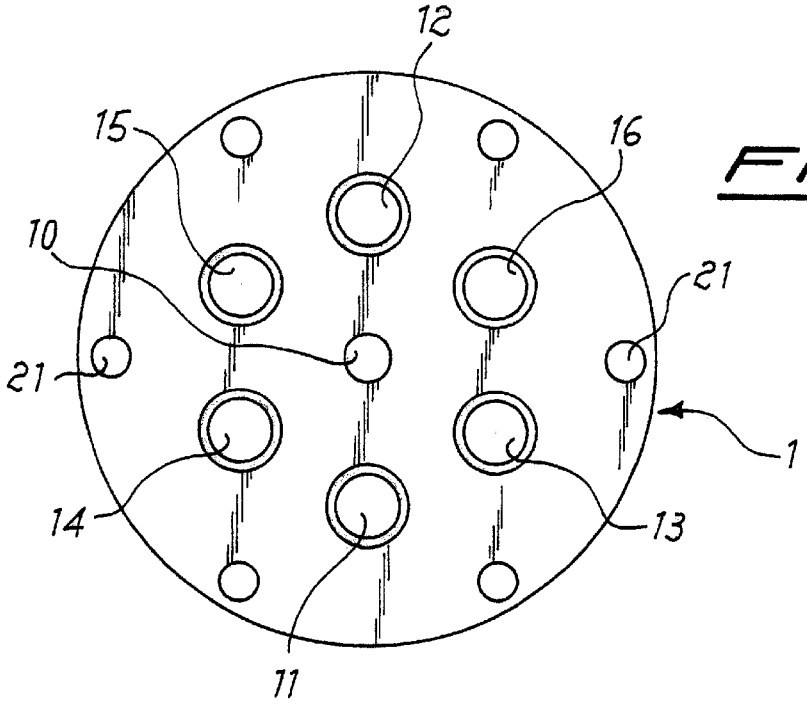
Figure 2B:
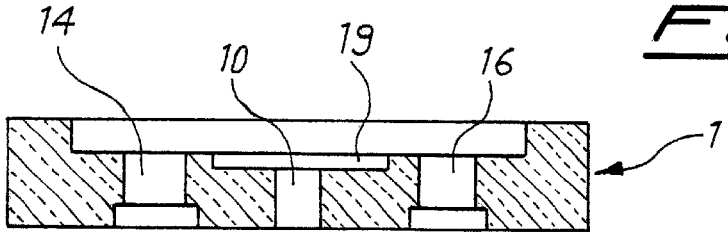

These and other objects, advantages and features of the valve according to the present invention will appear from the following detailed description of one embodiment thereof, which is reported as a non limiting example with reference to the accompanying drawings, wherein;

FIGS. 1 and 1*a* are two sectional views, respectively along the line I—I of FIG. 1*a* and line A—A of FIG. 1, of a control valve assembly according to the present invention:

FIGS. 2, 2*a* and 2*b* show the stationary ceramic collector disk 1 of the valve of FIG. 1 respectively in a top plan view of the same FIG. 1, that is taken from the side in engagement with movable disk 2, in a plan view taken from the opposite side and in a sectional view along the line B—B of FIG. 2;

FIGS. 3, 3*a* and 3*b* show the movable ceramic distributor disk 2 respectively in a top plan view of FIG. 1, that is taken from the side in engagement with the control pin, in sectional views along line III—III of FIG. 3 and along line III'—III' of FIG. 3*a;*

Figure 5:
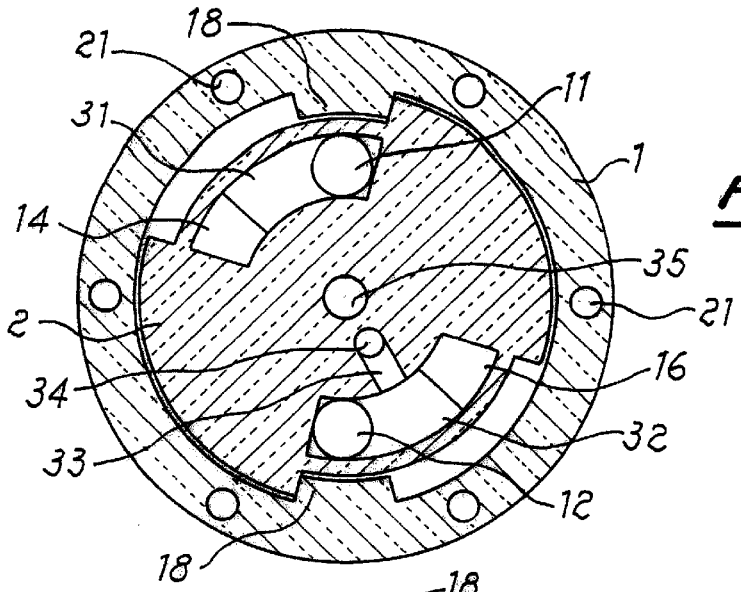
Figure 6:
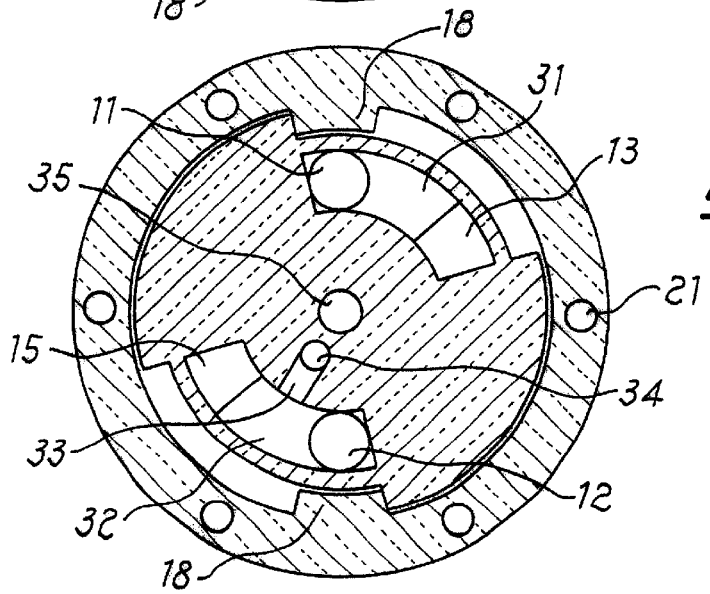
Figure 7:
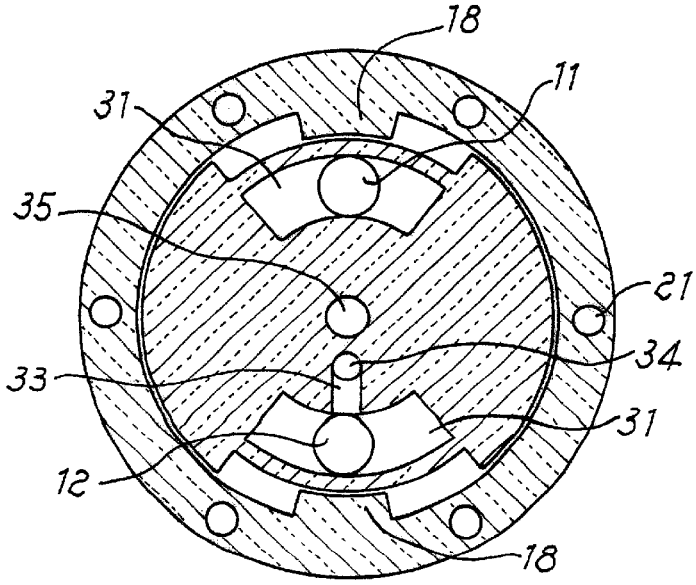

FIGS. 4 and 4*a* show the thrust compensator 3 of the valve of FIG. 1 respectively in a bottom plan view of FIG. 1, that is from the side of movable disk 2, and in a sectional view along the line IV—IV of FIG. 4; and FIGS. 5, 6 and 7 show sectional views like in FIG. 3*b*, in three different positions, of movable disk 2 with respect to the underlying stationary disk 1, with the corresponding positions of passage or shutting off of the ports on the stationary disk.

With reference to the drawings and particularly to FIGS. 1 and 1*a*, wherein the valve according to the present invention is represented in the whole, there can be seen that it is formed of a metal case 8 with lid 9 inside which a stationary collector disk 1, a movable distributor disk 2, both preferably made of self-lubricating ceramic, a thrust compensator 3, a polygonal terminal 4 integral with a central drive pin 5, connected to the servomotor which is not shown in the figure. The single elements 1–3 have been shown in greater detail in the FIGS. 2–4*a* respectively. The valve comprises further a pressing spring 6 with thrust bearing (7) and a pin 10 for centering the assembly. Further, screws 21' fixing stationary disk 1 to case 8 of the valve and sleeve 22 with sealing O-rings 23 for connecting stationary disk 1 to the pipes passing through case 8 of the valve are also provided. In the valve body there are also indicated, for each port, two threaded connections, a radial one (which can be seen for all the ports in FIG. 1) and an axial one (14*a* and 14*b* for port 14 in FIG. 1), in order to allow the greatest connection flexibility with the hot and refrigerated water distribution piping and with the apparatus heat exchanger; the ports which are not used will be closed by suitable threaded plugs.

Now, with reference to FIGS. 2–2*b*, there is particularly shown stationary ceramic collector disk 1 wherein six through ports are provided, which are so defined: 11 and 12 the one with circular cross-section for connection to the heat exchanger; 13 and 15 the inlet and outlet curved trapezoidal ones, for example for hot water; and 14 and 16 the inlet and outlet curved trapezoidal ones for refrigerated water. Holes 21 for the screws connecting to the valve case and a hole 35 for 10 centering with respect to the movable disk can also be seen, while with 18 two diametrally opposite end stroke stops are indicated, and with 19 a central lowered area in order to reduce the surface of contact with the movable disk itself.

With reference to FIGS. 3–3*b* there is particularly shown the movable ceramic distributor disk 2 wherein; 31 and 32 indicate two distribution channels inscribed in the ring-shaped area defined by the six through ports of the stationary disk, 33 indicates a hole for connection with the thrust compensator, and 34 the hole, communicating with hole 33, for inserting the duct of the thrust compensator 3. There is then provided hole 35 for pin 10 which provides the centering with respect to the stationary disk, a housing 36 for the thrust compensator 3 with a polygonal impression 37 for engaging the end plate 4 of the control pin 5. It is worth while noting that, since disk 2 slips onto disk 1, the contact surfaces are worked with a very high plane-grinding grade, in order to ensure a perfect adhesion between the two surfaces for a safe contact hydraulic seal.

Thrust compensator 3 is represented in particular in FIGS. 4 and 4*a* and is formed of two metallic disks 38 and 39 mutually connected by means of a corrugated metal circular wall 40. The inside of the chamber which is thus formed communicates with the outside through a pipe 41 which is intended to be inserted into hole 34 of movable disk 2 with hydraulic seal to be obtained by means of a suitable sealing material.

Polygonal end plate 4, being integral with control pin 5 of the valve, has not only the function of transmitting rotational motion from said pin to movable disk 2, but also that of opposing the thrust of compensator 3 by transferring it on pin 5, and, after all, on thrust bearing 7. It is to be noticed that it can have any profile, even different from the polygonal one, but not the circular one.

By referring again to FIGS. 2–2*b*, it is to be noted that the three pairs of ports 11, 12; 13, 15 and 14, 16, respectively connecting with the heat exchanger and with the hot and refrigerated water pipes, the last two having preferably trapezoidal curved shape, are all inscribed in a ring-shaped area and spaced by 60° from each other, so that the ports of each pair are staggered from each other by 180°. Circular channels 31 and 32, of rectangular cross-section, formed in movable disk 2 (see FIG. 3*b*), have the same width as said ring-shaped area, are diametrally opposite and their angular development is such that, when the disk is suitably rotated, the two heat exchanger ports (11 and 12 in the above assumption) are connected alternatively to the other two pairs of trapezoidal ports corresponding to the hot or refrigerated water. When the movable disk is in the intermediate position which is shown in FIG. 7, only heat exchanger ports 11 and 12 are uncovered, while the other four are shut off.

With respect to said position, it can be noted with reference to FIG. 5 that if movable disk 2 is completely rotated by 30° counterclockwise, it connects port 11 with port 14 and port 12 with port 16 by means of channels 31 and 32 respectively, thus allowing refrigerated water to supply the heat exchanger in the above assumption, while ports 13 and 15 or shut off.

On the contrary, with reference to FIG. 6, when movable disk 2 is completely rotated by 30° clockwise, port 11 is connected to port 13 and port 12 to port 15, again through channels 31 and 32, thus allowing hot water to supply the heat exchanger, while ports 14 and 16 are shut off. In this regard it is to be noted that, with particular reference to FIG. 2*b*, the ports having trapezoidal shape take, through the thickness of stationary disk 1, a circular shape on the lower opposite side in order to allow connection with the corresponding holes provided on case 8 of the valve by means of suitable sleeves, such as the one indicated with 22.

The function of the thrust compensator 3 particularly shown in FIGS. 4, 4*a* is automatically balancing static and dynamic thrust exerted by a the water of the system onto movable disk 2 through the ports. In fact, the inside of the compensator defined by the two disks 38 and 39 and by the peripheral wall made of corrugated sheet 40 is communicating, through pipe 41, with one of the two channels 31, 32 of movable disk. The plane surfaces of compensator 3 have preferably an area which equals the sum of the four parts 13–16 which can be shut off and of the two channels 31, 32, whereby the valve operation is not influenced by the hydraulic pressure existing in the supply circuits.

It is also to be noticed that adhesion between disks 1 and 2 is obtained by means of a spring 9 pressing against movable disk 2 and that, by virtue of compensating device 3, the pressure exerted by the spring can be greatly reduced with positive effects both for the disks life and for the torque which is necessary for the valve handling, as the servocontrol is subjected to a rotating movement ±30. Obviously, the movable disk can assume any position within the 60° of stroke, that is, within the positions shown in FIGS. 5 and 6, in either direction with respect to the central neutral position of FIG. 7, when considering that such a position depends on the response of the servocontrol, with modulating effect, to the signal sent by the thermostatic system, with consequent regulation of the water flow rate in a linear way from 0 to 100%. In such a way, the desired proportionality requirement is obtained, which consists in a fluid flow rate directly proportional to the stroke of the shutting off member. In the rectilinearly moving valves, said member is normally formed of a shutter with respect to the valve seat but in that case such a requirement is very difficult to be obtained, due to the stroke being reduced with respect to the diameter. On the contrary, with the six-way rotating valve according to the present invention, said requirement is met because movable disk channels 31 and 32 uncover portions of trapezoidal port pairs which are directly proportional to the angles of rotation.

Last point to be considered, for the valve according to the invention, is the value of the previously mentioned characteristic $K_v$. This value is very important because it allows adapting the valve characteristic to that of the circuit to be controlled. According to the present invention, valves having different characteristics can be obtained without having to build them every time, but starting from a single basic valve. It will be enough to vary the internal diameter of duct 22 inserted into one of the two connections to the heat exchanger, starting from the maximum value, equal to that of the hole in which it is inserted, in order to obtain, with the same pressure drop (1 bar), a smaller water flow in the time unit and therefore a reduction of the characteristic $K_v$.

For example, the yield of the cooling heat exchanger of "four pipe" fan-convector is normally calculated for a medium logarithmic temperature of about 10 K, never going with the refrigerated water temperature at the heat exchanger inlet under 9° C., in order to avoid atmospheric condensation effects on the heat exchanger itself and with a dry bulb temperature of the air at the heat exchanger inlet of 26° C. On the contrary, the heating heat exchanger can be calculated for a medium logarithmic temperature up to 45 K. Since the heating and cooling thermal loads are substantially similar, the hot heat exchanger surface can be much more reduced than the cold one, but with the need of reaching rather high temperatures, as previously mentioned. With a single heat exchanger as provided for and made possible by using the six-way rotative valve of the present invention, the logarithmic temperature in the cooling phase would be always 10 K, while the one in the heating phase would be about 12 K. This means that the temperature of the water being fed could also be only 40°, with air at the heat exchanger inlet of 20° C., resulting in the possibility to use alternative energy sources for heating, such as heat pumps or solar collectors.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A servocontrolled valve for regulating air-conditioning apparatuses provided with air moving equipment, on the basis of the locally sensed temperature by means of a thermostatic device, with a four pipe water distributing system for supplying a heat exchanger, characterized in that it comprises, in a valve body (8) with lid (9), wherein hydraulic connections (22) with the four pipes of the system are provided, a stationary collector ceramic disk (1) with three pairs of through ports (11, 12; 13, 15; 14, 16), placed inside a ring-shaped area respectively for connecting to the heat exchanger, with the two hot and refrigerated water pipes, the ports of each pair being spaced by 180° between each other with respect to the center of the disk (1) around which a movable distributing disk (2) can rotate closely contacting the stationary disk (1), said movable disk (2) being provided with two diametrally opposite distribution channels (31, 32) inscribed in said ring-shaped area, and with a central impression for engaging a polygonal plate (4) integral with a valve control pin (5) connected with the servocontrol member in order to impress a rotation movement in either direction to said movable disk (2) thus shutting off one or the other pair of ports (13, 15; 14, 16) and allowing connection, with partial or full flow by means of said two channels (31, 32), between the two ports (11, 12) connecting to the heat exchanger and the two ports which are not shut off.

2. A valve according to claim 1, characterized in that it further comprises a pressing spring (6) with thrust bearing (7) suitable for acting between said lid (9) and the movable disk (2) in order to keep it at close contact with the stationary disk (1), both said disks (1,2) being made of self-lubricating ceramic.

3. A valve according to claim 2, characterized in that it further comprises a thrust compensator (3) between said polygonal plate (4) and movable disk (2), being formed of a deformable chamber between two metal disks (38, 39) communicating by means of a pipe (41) with one of said channels (31, 32) of the movable disk (2) and thereby with the flow coming from one of the feeding ports.

4. A valve according to claim 1, characterized in that it further comprises, on the stationary disk (1), diametrally opposite stops (18), suitable for limiting in both directions the rotation of movable disk (2), at the ends of said channels (31,32).

5. A valve according to claim 4, characterized in that the rotation allowed by said stops (18) is of about 60° in total, 30° clockwise and 30° counterclockwise, with respect to a central neutral position wherein all the ports (13, 15; 14, 16) for communication with the four pipes are shut off, and the free ports (11, 12) are not fed.

6. A valve according to claim 1, characterized in that said through ports (13, 15; 14, 16) having circular cross-section at sleeves (22) connecting with the four pipes of the system, are provided, on the opposite side of the stationary disk (1), with curved trapezoidal cross-section, inside said ring-shaped area, in order to allow choking of the passage area thereof as a function of the angle of rotation of movable disk (2), with flow rate proportional, by means of the servocontrol, to the signal given by the thermostatic device.

7. A device according to claim 1, characterized in that in the valve body (8) two threaded connections are provided for each port, a radial one and an axial one, in order to allow the greatest flexibility of connection with the four distributing pipes and with the heat exchanger of the apparatus.

* * * * *